US005806669A

United States Patent [19]

Kim

[11] Patent Number: 5,806,669

[45] Date of Patent: Sep. 15, 1998

[54] RAZOR SUPPORT STRUCTURES FOR CONTAINERS

[76] Inventor: Paul Kim, 16901 Cod Cir., Apt. No. D, Huntington Beach, Calif. 92647

[21] Appl. No.: 730,790

[22] Filed: Oct. 16, 1996

[51] Int. Cl.[6] ..... B65D 69/00

[52] U.S. Cl. ..... 206/228; 206/349; 248/229.16; 248/229.25

[58] Field of Search ..... 206/576, 581, 206/228, 231, 234, 349; 30/34.05; 248/229.16, 229.2, 229.25, 229.26, 230.7; 220/735, 737, 738

[56] References Cited

U.S. PATENT DOCUMENTS

| | | | |
|---|---|---|---|
| 432,305 | 7/1890 | Foley | 248/229.26 |
| 884,256 | 4/1908 | Addie | 248/229.26 |
| 1,774,775 | 9/1930 | Wiltz, Jr. | 248/229.26 |
| 1,891,099 | 12/1932 | Land | 248/229.26 |
| 1,998,232 | 4/1935 | Gould . | |
| 3,272,323 | 9/1966 | Ewry . | |
| 3,486,630 | 12/1969 | Ellman . | |
| 3,521,332 | 7/1970 | Kramer . | |
| 3,596,859 | 8/1971 | MacDonald | 248/229.26 |
| 3,772,742 | 11/1973 | Gigante . | |
| 4,121,798 | 10/1978 | Schumacher et al. | 248/229.26 |
| 4,141,445 | 2/1979 | Korich | 206/228 |
| 4,232,785 | 11/1980 | Lucas | 206/228 |
| 4,320,832 | 3/1982 | Edstrom | 206/228 |
| 4,334,642 | 6/1982 | Reisch | 220/737 |
| 4,450,980 | 5/1984 | Clabby . | |
| 4,555,030 | 11/1985 | Byrne et al. . | |
| 4,646,999 | 3/1987 | Clark . | |
| 4,695,029 | 9/1987 | Fox et al. . | |
| 4,836,403 | 6/1989 | Blackman . | |
| 5,288,047 | 2/1994 | Pan | 248/229 |
| 5,544,783 | 8/1996 | Conigliaro | 220/735 |
| 5,607,230 | 3/1997 | Protz, Jr. | 248/229.16 |

*Primary Examiner*—Paul T. Sewell
*Assistant Examiner*—Nhan T. Lam
*Attorney, Agent, or Firm*—Curtis L. Harrington

[57] ABSTRACT

Several embodiments of a disposable razor support structure include structures from which support is derived including (1) a clip for encircling and grasping the major portion of a can and which also grasps the disposable razor just below the head portion; (2) a cap support which engages a can in a manner identical to that of the way in which a cap engages the can; (3) a cap which engages a can; and (4) a magnetic attachment member which can adhere to either a can or other metal surface; (5) a horizontal can tray which can accommodate a can; and also structures for supporting a disposable razor including (1) a clip in the shape of an Ω which grasps the upper handle of a razor, and (2) a trough to gently support the head of the razor, either of which can draw support from any of the structures described above.

5 Claims, 11 Drawing Sheets

RAZOR SUPPORT STRUCTURES FOR CONTAINERS

FIELD OF THE INVENTION

The present invention relates to support structures which depend from containers and more particularly to a structure which depends from product containers relating to the toiletries industry and which can support lightweight structures.

BACKGROUND OF THE INVENTION

Safety razors and similar structures have evolved from a heavy metal blade holder to a light weight plastic disposable structure. The heavy metal blade structures provided for a disposable blade. When the blade became dull because it was wet or worn, the only portion which was disposed of was the thin metal portion. With the one piece plastic disposable structures presently provided, a worn or corroded blade results in the whole unit being disposed. In presently used structures, one or two blade edges may be present and they can quickly corrode if left laying in a down position in water and especially in a soap dish.

To extend the time of usage of the disposable by 7 to 10 days would not only be of economic advantage to the user, but would also slow the stream of disposable razors headed toward the refuse collection system. In addition, any structure which adequately supported a disposable razor would contribute to the tidiness of the bathroom areas since disposables are normally placed flat on the counter. Flat placement is normally with the blades facing down, which contributes to their corrosion and short life, for both metal and plastic disposable razors. Further, when razors are left lying about, they form an extreme hazard for children who are easily cut just by coming into contact with the razors.

Another problem with disposable blades is packaging. They do not stack well and are generally packaged densely in a soft pack. It is difficult to provide a single razor with, for example, a can of shaving cream without the use of shrink wrap packaging. This is difficult to achieve by machine since the razor may not always be positioned properly on the can. Further, since the blade area may be pressed against the can, a bump or other side impact can bend and ruin the blades. Where the razor is facing away from the can during shrink wrap, it may be further damaged by other forces from the outside.

What is therefore needed is a support which may be used in packaging which will support a razor proximate to a can in a position where the razor will not be damaged. Further, and in order to conserve resources, the needed support should be amenable to further permanent use to support later acquired disposable razors for the user. Further, and to avoid confusion the support should accommodate a single razor so that the user will continue to use a single razor until it is worn enough to be replaced by another new razor. In this manner a significant savings would result in the case of a user who continually opens new razors only to leave them exposed in a wet environment to corrode. The support will also contribute to the lengthening of the life of permanent metal razors having disposable blades, or metal razors having plastic disposable blade cartridges.

Another problem within the environment of disposable razors and shaving cream cans is that of rust at the bottom of the can. Although most cans have a generous coating of lacquer or enamel, being left in a wet environment over time can cause rusting of the bottom rim and exposure of the raw metal can. Although the can will be discarded after use, rust from the bottom of the can will discolor surfaces on which it is placed, including enamel sinks and enamel finish medicine cabinets. Generally damage from this rust discoloration can be prevented only by providing a specialized surface on which the can will be stored. What is needed is a razor support structure which can both support and collect a shaving can and razor and will also prevent rust discoloration.

The razor support structures needed may be of several types and may be able to provide support in a variety of circumstances. Various supports should encompass a variety of support opportunities. The needed supports should be able to engage round objects, flat surfaces, and the tops of cans. The needed supports should either enable a disposable razor to continue to utilize the blade guard which was supplied with the razor, or should eliminate the need for the guard by providing a protective enclosure for the head of the razor.

SUMMARY OF THE INVENTION

Several embodiments of a disposable razor support structure include structures from which support is derived including (1) a support structure in the shape of a special clip for encircling and grasping the major portion of a can and which also grasps the disposable razor just below the head portion; (2) a cap support which engages a can in a manner identical to that of the way in which a cap engages the can; (3) a cap which engages a can; and (4) a magnetic attachment member which can adhere to either a can or other metal surface; (5) a horizontal can tray which can accommodate a can; and also structures for supporting a disposable razor including (1) a clip support structure in the shape of an Ω which grasps the upper handle of a razor, and (2) a trough to gently support the head of the razor, either of which can draw support from any of the structures described above.

BRIEF DESCRIPTION OF THE DRAWINGS

The invention, its configuration, construction, and operation will be best further described in the following detailed description, taken in conjunction with the accompanying drawings in which:

FIG. 14 is a fifth embodiment includes a full length cup, within which a shaving cream can may sit and which is a full length cup which not only insulates the can from any surface, but which is also a washable cup which may be used to assist in brushing the teeth and the like;

DETAILED DESCRIPTION OF THE PREFERRED EMBODIMENT

Figure 1:
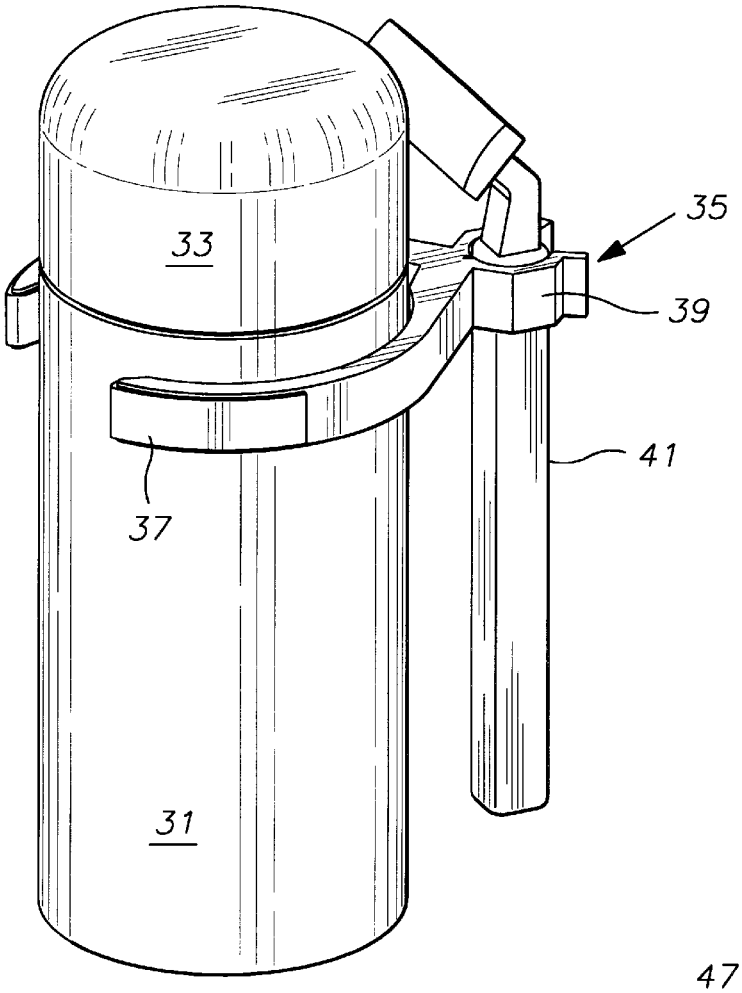
FIG. 1A illustrates a perspective view of a first embodiment of the invention having an enlarged clip for engaging a can of shaving cream or the like and a smaller clip for engaging the upper portion of the handle of a razor.

The description and operation of the invention will be best described with reference to FIG. 1. FIG. 1 illustrates a conventional can 31 having a conventional cap 33. Typically the can 31 will be a can of pressurized shaving cream or shaving gel, since this type product is closely associated with shaving, although a can 31 of deodorant or the like, or any other can 31 is acceptable.

A support structure 35 of the present invention as shown in FIG. 1 includes a large clip portion 37 which partially encircles the can 31. The large clip portion 37 is attached to a small clip portion 39 which grasps a razor 41. Razor 41 can be any razor, but may especially be a disposable razor.

Figure 2:
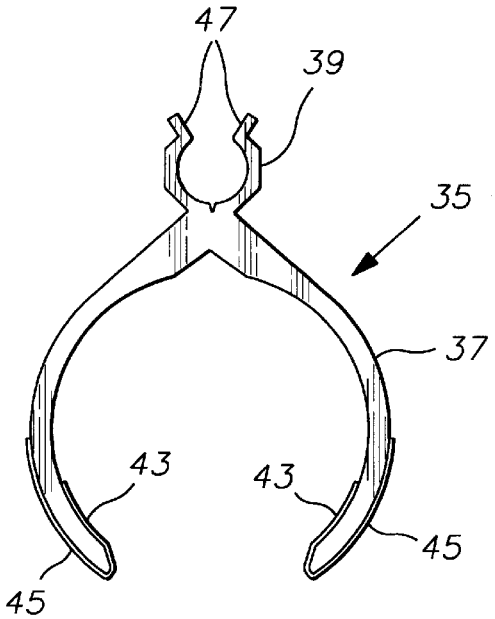
FIG. 2 illustrates a top view of the support shown in FIG. 1.

Referring to FIG. 2, a top view of the support structure 35 illustrates several options which are available. The large clip portion 37 has a pair of gripper inserts 43. The gripper inserts 43 may be attached to the inside of the large clip portion 37, or they may be inserted through the large clip portion 37 and extend outside the large clip portion. Exterior oriented gripper portions 45 may be integral with the gripper portions 43 or independent. The exterior gripper portions 45 does help in grasping the integrated unit shown in FIG. 1. Gripper portions 43 and 45 may also be neoprene pads.

The small clip portion 39 has a pair of end portions 47 which extend away from each other and which act to help open partially the small clip portion as a handle of the razor is laterally moved into the small clip portion.

Figure 3:
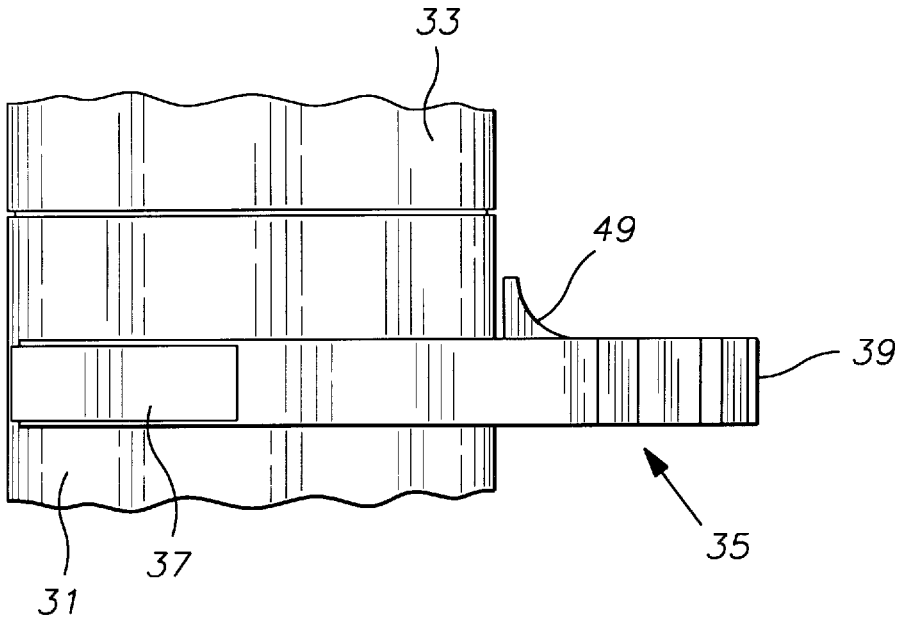
FIG. 3 is a closeup view of a co-planar version of the support of the invention shown in FIGS. 1 and 2.

Referring to FIG. 3, a variation in the support structure 35 is shown as including an upwardly extending brace portion 49 which will enable the support structure 35 to be grasped and lifted to take the can 31 with it. This brace 49 strengthens the support structure 35 and reduces the bending moment experienced at the end of the support structure 35.

Figure 4:
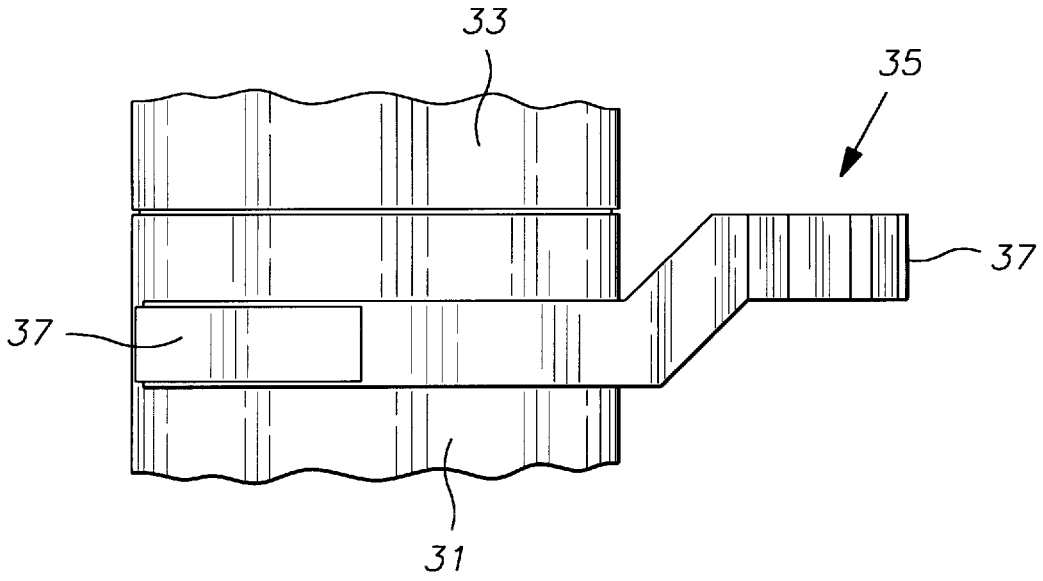
FIG. 4 is a version of the support of the invention wherein the portion of the clip which engages the razor lies in a plane above the plane of the portion of the clip which engages the can.

Referring to FIG. 4, a further variation of the first embodiment of the support structure 35 is shown in which the small clip portion 39 lies in a first plane above the large clip portion 37 which lies in a second plane. A mere reversal of the support structure 35 would place the small clip 39 below the plane of the large clip 37.

Figure 5:
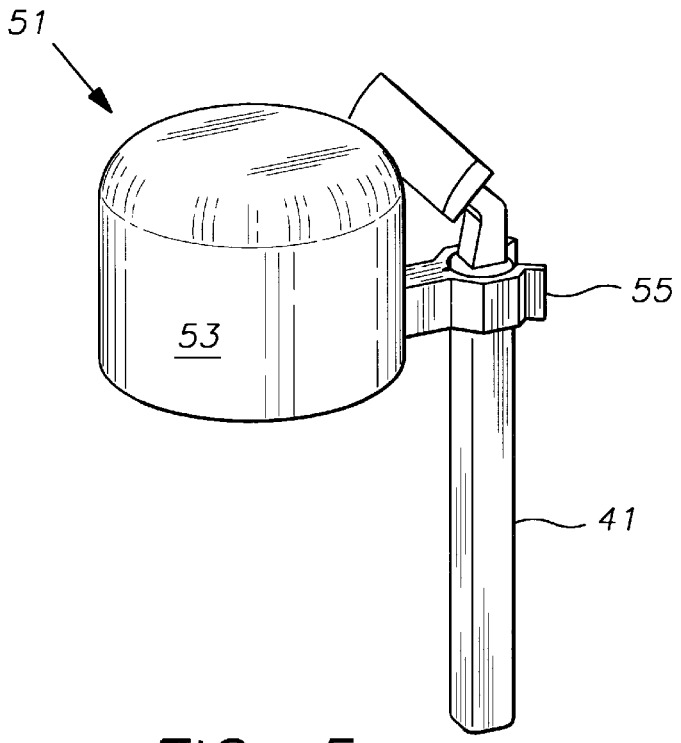
FIG. 5 illustrates a second embodiment where the clip for holding the upper portion of the handle of a razor extends from a cap engageable with the top of a can.

Referring to FIG. 5, a second embodiment of the present invention is shown as a cap support 51 having a cap portion 53 and a small clip portion 55 formed integrally with the cap portion 53. Again, the razor 41 is shown as supported by the small clip portion 55. The distance of the small clip portion 55 from the cap portion 53 can be varied to accommodate a razor 41 having a greater or lesser angular displacement of the blade head.

Figure 6:
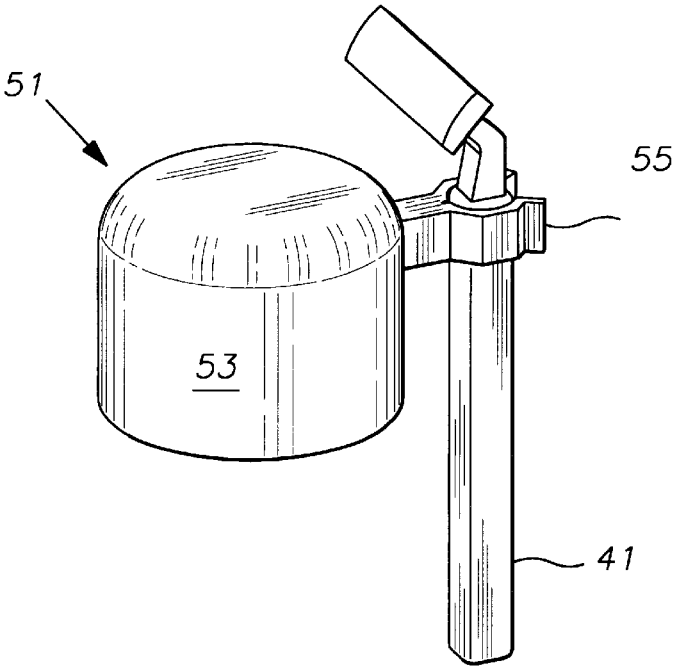
FIG. 6 illustrates a variation of the second embodiment wherein the smaller clip is carried high up on the cap.

Referring to FIG. 6, a different version of the cap portion 53 is shown where the small clip portion 55 extends from the cap portion 53 at a point higher up on the cap portion 53. This enables the space above the cap portion 53 to be accessed by the head portion of the razor 41. This configuration is especially useful where space exists above the cap portion and the razor 41 is packaged with the cap support 51.

Figure 8:
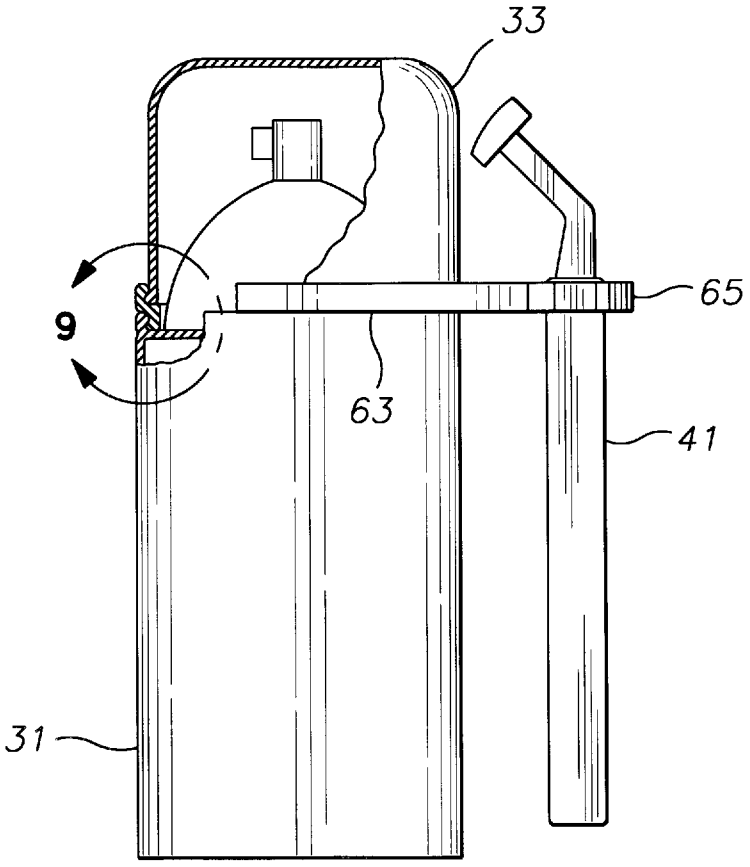
FIG. 8 is a side view of a can of shaving cream with the ring of FIG. 7, and with a broken away view from one side of the can leading to the cap.
Figure 7:
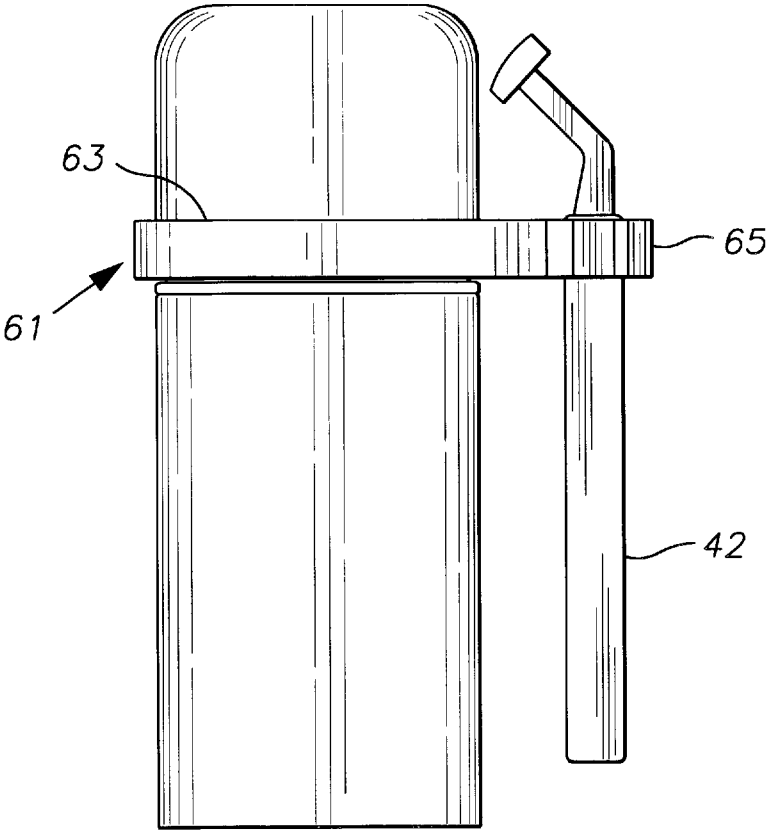
FIG. 7 illustrates a third embodiment illustrates a third embodiment in which the clip for holding the upper portion of the handle of a razor extends from a ring engageable with the top of a can identical to the manner in which a cap engages a can, but where the ring has an upper portion further engageable with a conventional cap, to enable the can to be secured with the cap whether or not the ring is in place.

FIG. 7 illustrates a third embodiment which includes a conventional cap 33 and a support structure 61 having an intermediate interlocking ring portion 63 and a small clip portion 65. The interlocking ring portion 63 has a lower surface which is equivalent to the bottom of the conventional cap 33 it replaces. The version shown will include a cap 33 having an abbreviated outwardly directed rim. Referring to FIG. 8, a semi sectional view of the ring of FIG. 7 shows how the intermediate interlocking ring portion 63 rests atop the can 31.

Figure 9:
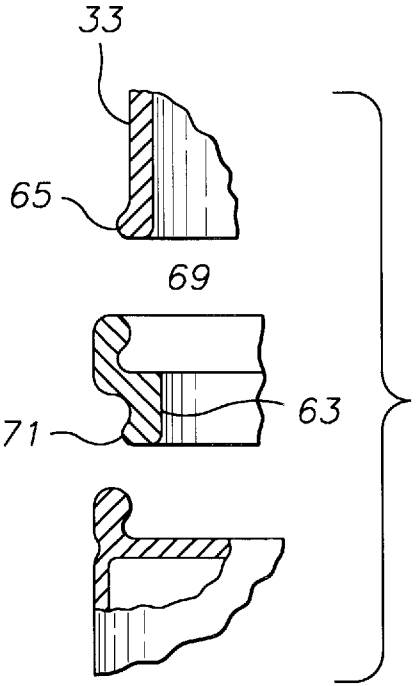
FIG. 9 is a closeup partially sectional view of the ring and cap shown in FIGS. 7 and 8 and illustrating the separate interlockability of the ring, can and cap.

Referring to FIG. 9, a full exploded cross section illustrates the components of the third embodiment. Cap 33 has an abbreviated lower, outwardly disposed rim 67. The interlocking ring portion 63 is shown as having an upper, inwardly directed groove 69 which will accommodate the rim 67 to enable the cap 33 to lock onto the ring portion 63. The lower edge of the ring portion 63 has an outwardly disposed rim 71 which is the same size and shape as the outwardly disposed rim 67 of the cap 33. In this configuration, the system including the cap 33, support structure 61, and can 31, can be configured to include or exclude the support structure 61. Fully made up, the support structure 61 sits atop the can 31, and the cap sits atop the support structure 61, with all three of these structures being interlocked. Once the support structure 61 is removed, the cap 33 can be locked directly onto the can 31.

Figure 10:
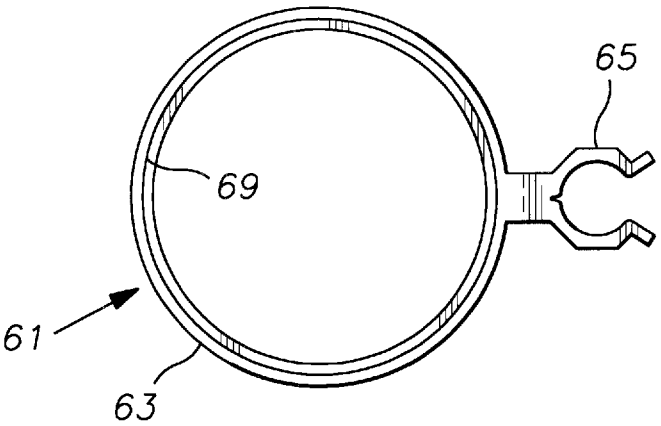
FIG. 10 is a top view of the ring shown in FIGS. 8–11.

Referring to FIG. 10, a top view of the support structure 61 is shown. As can be seen, the structure overlying the inwardly directed groove 69 is seen as continuously extending about the support structure 61. The small clip 65 can be seen as extending from the ring portion 63.

Figure 11:
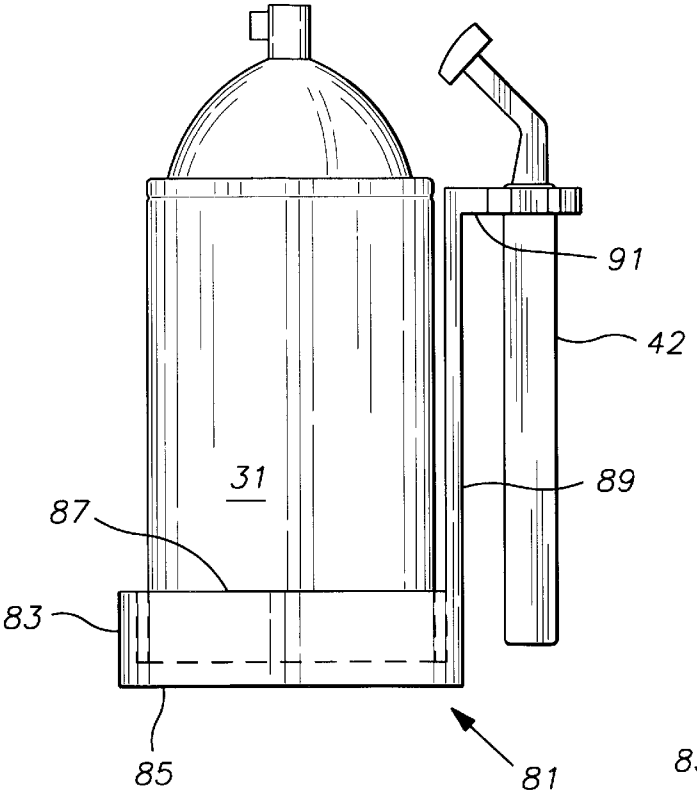
FIG. 11 illustrates a fourth embodiment which includes a small height base and support pole which extends from a shallow pan which is used to both support and insulate the bottom of the can from any contact with a surface in which discoloring rust might escape from the can.

Referring to FIG. 11, a fourth embodiment illustrates the conventional can 31 supported within a support structure 81 having a cylindrical portion 83 having a closed end 85 and a rim 87 which rises into a vertical support portion 89 which supports a small clip 91. The lower portion of the vertical support portion 89 is relatively wide to withstand pulling motion imposed on the small clip 91 when the razor 41 is being pulled away from the small clip 91.

Figure 13:
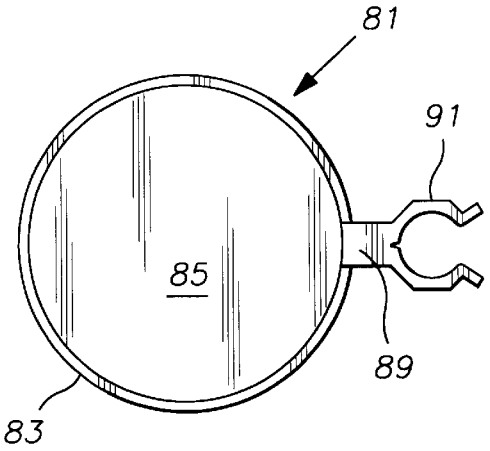
FIG. 13 is a top view of the fourth embodiment of FIGS. 11 & 12.
Figure 12:
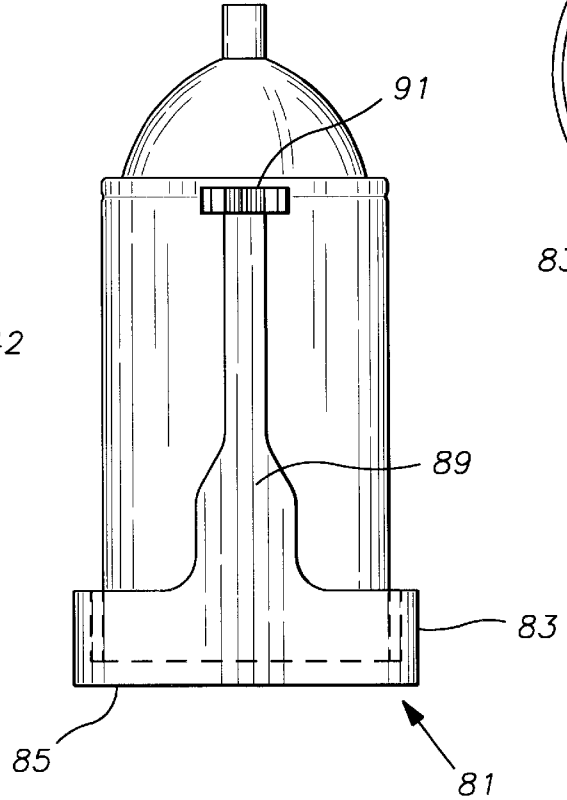
FIG. 12 is an end view illustrating details of the support post of the fourth embodiment of FIG. 12.

Referring to FIG. 12, a profile of the vertical support portion 89 is better seen. Referring to FIG. 13, a top view looking down into the support structure 81 better illustrates the closed end 85 and, along with FIGS. 11 and 12, gives a more complete look at the entire structure.

Figure 15:
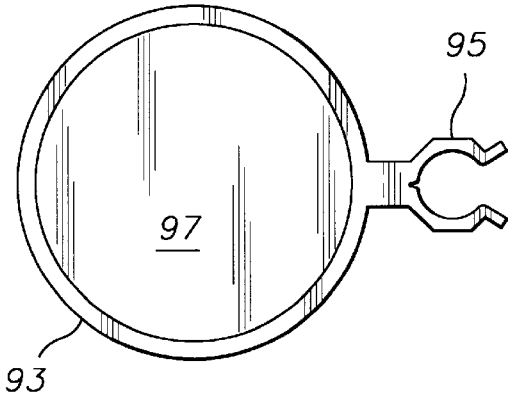
FIG. 15 illustrates a top view of the fifth embodiment as shown in FIG. 14.
Figure 14:
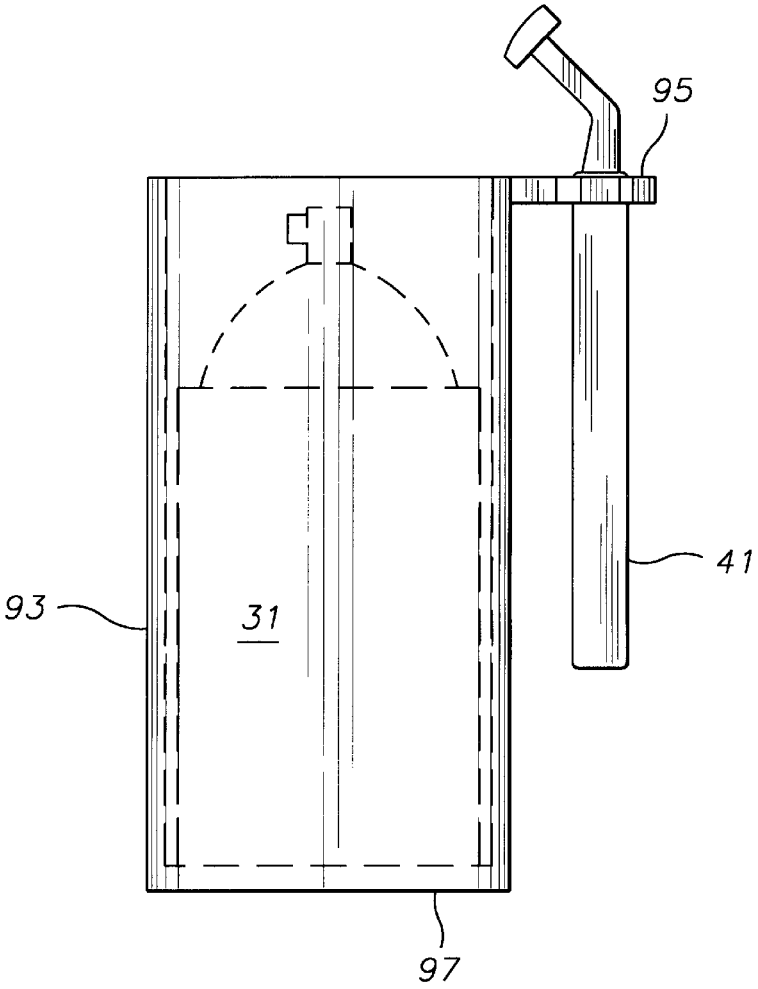

Referring to FIG. 14, a fifth embodiment as a cup shaped support structure 93 has a small clip portion 95 supporting razor 41, and a lower closed end 97. As can be seen, a conventional can 31 is supported within the cup shaped support structure 93 and is thus further protected. The cup shaped support structure also insulates the bottom of the can 31 from any surface on which the cup shaped support structure 93 sits. In addition, the cup shaped support structure 93 doubles as a drinking cup, which is advantageous for brushing teeth, camping and other situations where a cup might be needed. FIG. 15 illustrates a top view of support structure 93 and the closed end 97 can clearly be seen.

Figure 16:
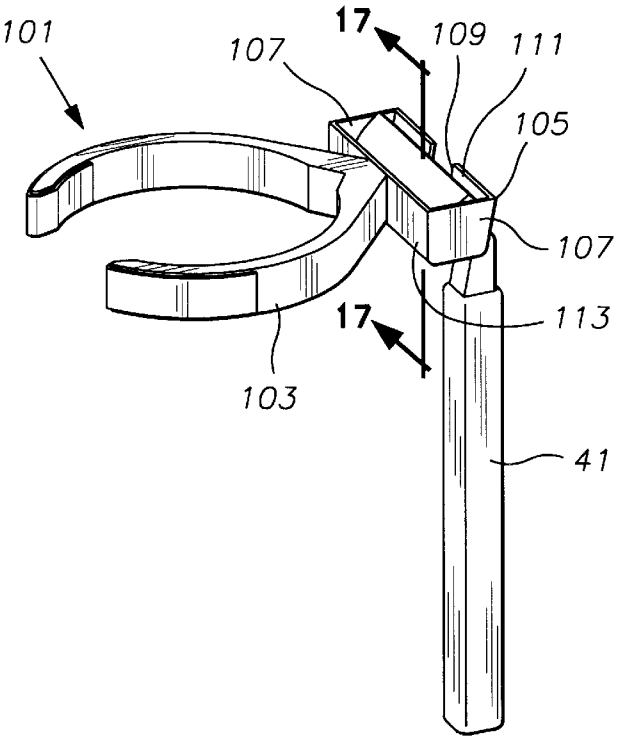
FIG. 16 illustrates a perspective view of a sixth embodiment which includes a full holder for gravity support of the razor which enables elimination of the razor guard since the razor head is cupped in its holder which has a trough with a pair of closed ends.
Figure 22:
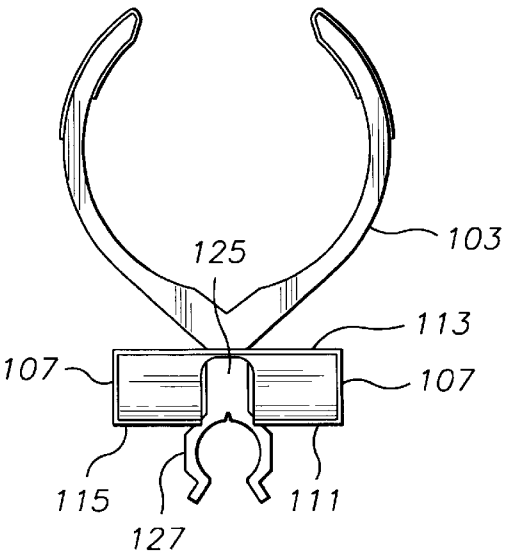
FIG. 22 is a top view of the seventh embodiment shown in FIGS. 20 and 21.
Figure 23:
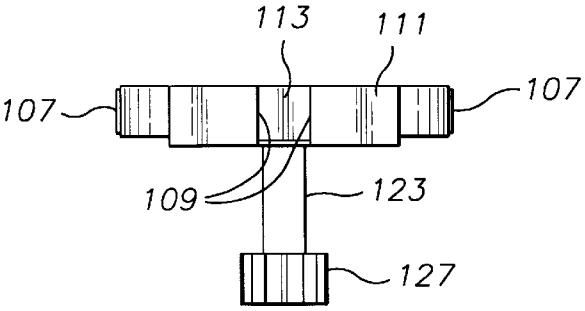
FIG. 23 is a front view of the trough and below trough clip portion of the seventh embodiment of FIGS. 20–23.

Referring to FIG. 16, a sixth embodiment has a specialized structure for supporting the razor 41 by its head portion. A support structure 101 includes a large clip portion 103, and a trough portion 105. The trough portion 105 has a pair of end portions 107 which lend stability, but are not otherwise required. The trough portion 105 reveals a slot 109 which extends through an outer, tilted but generally vertical wall 111, and an inner vertical wall 113.

Figure 17:
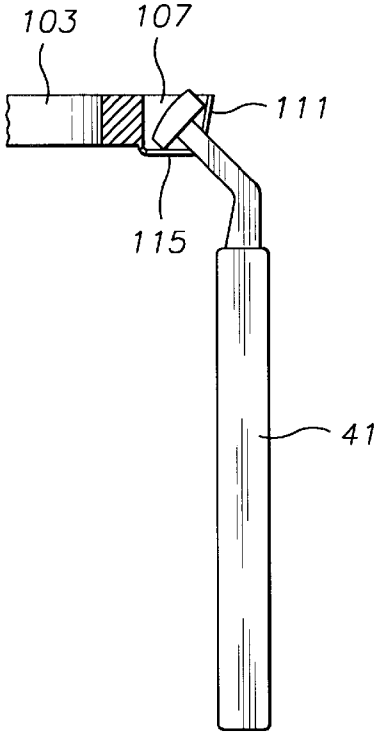
FIG. 17 is a side end view of the sixth embodiment of FIG. 16.

Referring to FIG. 17, a side sectional view taken along line 17—17 illustrates a bottom side 115 of the trough, as well as the edge of the slot 109 which is seen along the vertical wall 111 and bottom side 115 from the perspective of FIG. 17.

Figure 18:
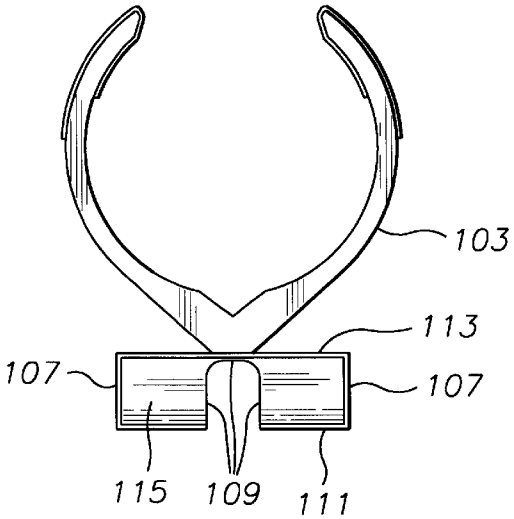
FIG. 18 is a top view of the sixth embodiment of FIGS. 17 and 18.
Figure 19:
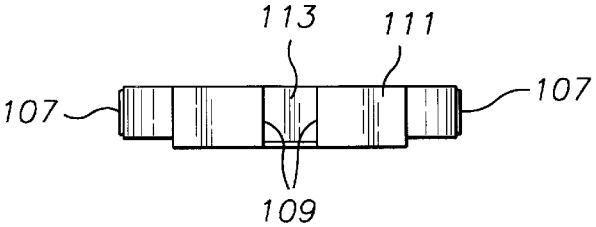
FIG. 19 is front view of the trough portion of the sixth embodiment.

Referring to FIG. 18, a top view illustrates the bottom side 115 and the full extent of the slot 109 as going completely through the bottom side 115. In this configuration, the razor 41, even if it has a completely straight handle, can allow the handle to hang vertically downward. FIG. 19 illustrates the slot 109 from a front view. Again, the end walls 107 are optional and add strength to the trough portion 105.

Figure 20:
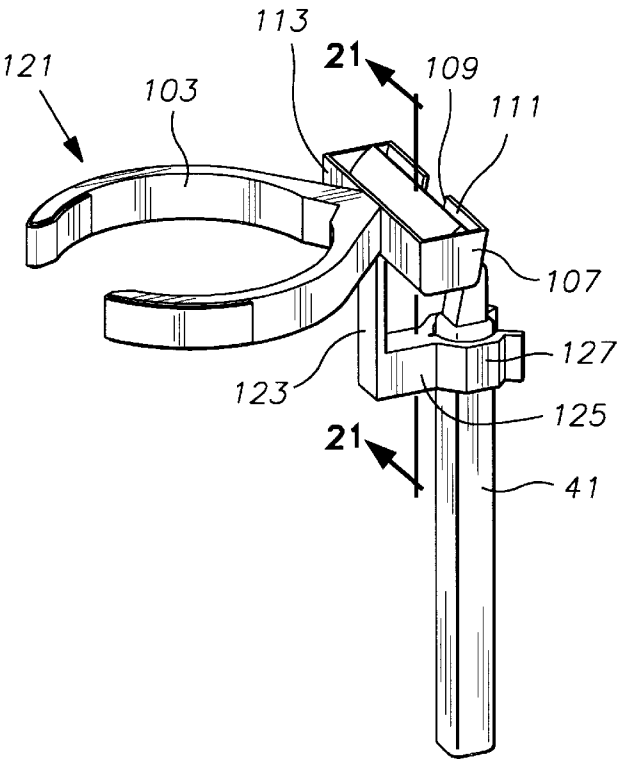
FIG. 20 illustrates a perspective view of a seventh embodiment which includes a small clip displaced from the bottom of the trough structure shown in FIGS. 16–19, and which enables the head of a razor to be placed in the trough with its handled is swung down into place to be engaged by the clip.

Referring to FIG. 20, an eighth embodiment is a variation of the seventh embodiment combining trough support and clipped support. A support structure 121 has members which are identical to those of the support structure 101, but contains an important addition. A vertical member 123 extends downward from a point near the junction of the inner vertical wall 113 and the middle of the large clip portion 103. The vertical member 123 supports, in the case of FIGS. 20–23, an abbreviated length horizontal member 125. The horizontal member 125 supports a small clip 127.

Figure 21:
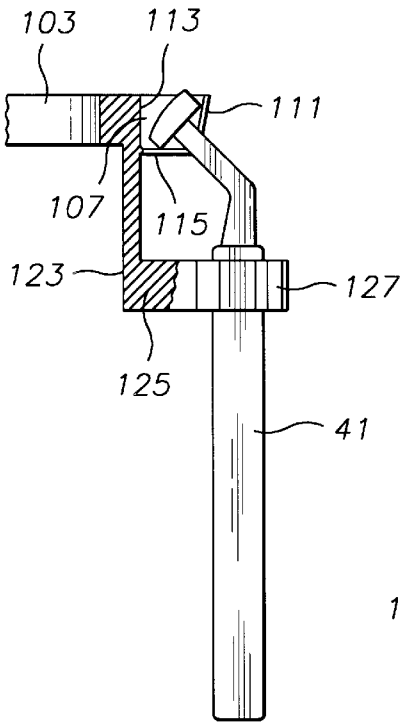
FIG. 21 is a side sectional view of the seventh embodiment of FIG. 20.

Referring to FIG. 21, it can be seen that the razor 41 has a head which is angled with respect to its handle and thus the necessity for the horizontal member 125 to be extended slightly. Where the razor 41 has a straighter profile, the horizontal member 125 need not be present, or perhaps need not provide as much extension of the small clip 127 away from the large clip portion 103.

Figure 28:
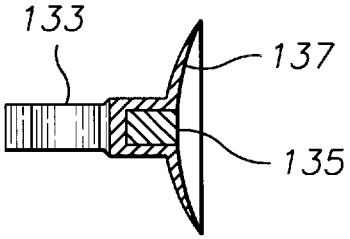
FIG. 28 is a sectional view taken along line 28—28 of FIG. 27, and illustrating the placement of the magnet at the center of the suction cup magnet stabilization structure.
Figure 29:
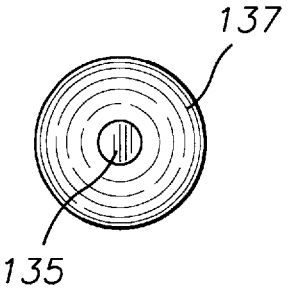
FIG. 29 is a rear view of the ninth embodiment shown in FIGS. 27–29 and showing the exposed end of the magnet.
Figure 27:
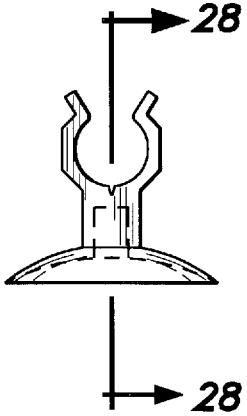
FIG. 27 is an eighth embodiment of the invention and illustrating a small clip supported by a trough structure connected to a combination suction cup and magnet stabilization structure with magnet.

Referring to FIG. 28, an eighth embodiment of the present invention is illustrated as support structure 131 and has a clip 133 attached to a structure which includes a magnet 135 encased within a suction cup and magnet stabilization member 137. FIG. 27 illustrates a top view and a point of reference for the section lines about which FIG. 28 is taken. FIG. 29 illustrates a rear view which illustrates the surface of the magnet 135.

Figure 25:
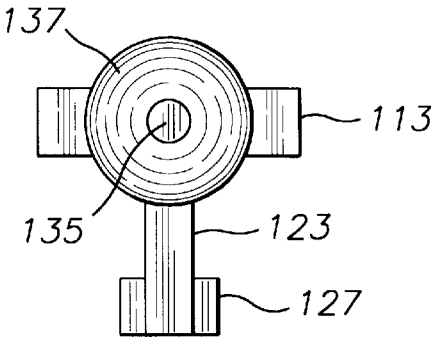
FIG. 25 is a rear view of a variation on the eighth version of FIG. 24 and similar to FIGS. 20–23 in which a clip is mounted below the trough structure to stabilize the razor.
Figure 26:
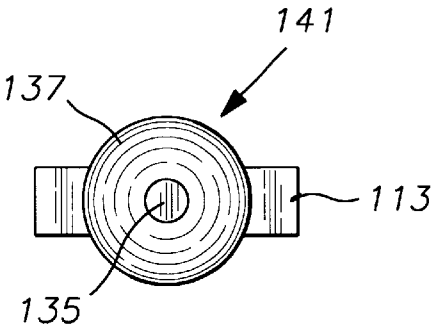
FIG. 26 is a rear view of the embodiment of FIG. 24.
Figure 24:
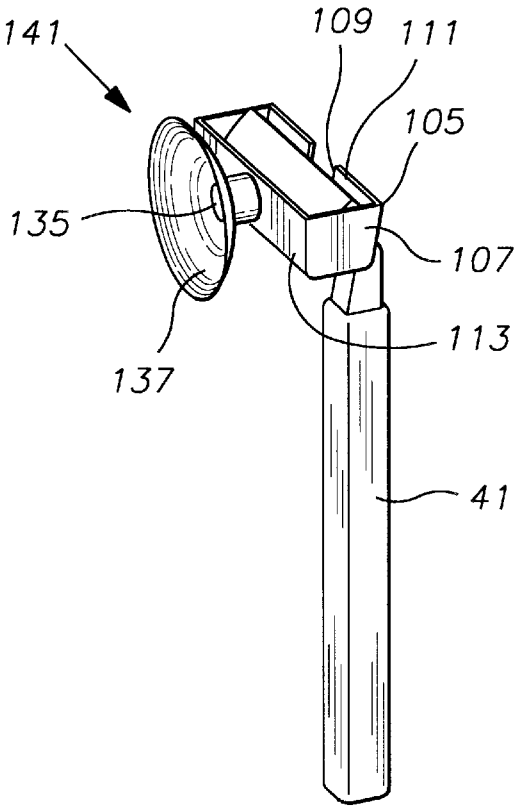
FIG. 24 is a perspective view of an ninth embodiment having a trough structure connected to a combination suction cup and magnet stabilization structure.

Referring to FIG. 24, a variation on the trough 105 structure of FIGS. 20–23 illustrates the magnet 135 and suction cup and magnet stabilization member 137 supporting the trough 105. The result is support structure 141. FIG. 26 gives a rear view of the suction cup and magnet stabilization member 137. FIG. 25 is a variation on the support structure 141 which has a vertical member 123 to support the small clip 127, similar to the embodiments illustrated in FIGS. 20–23.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A support comprising:

a first clip member having a rounded shape and having a pair of ends;

a second clip member, attached to and smaller than said first clip member, and having a rounded shape including a main circular length having a pair of ends connected to a pair of symmetrical end portions which extend away from each other, said main circular length attached to the mid point of said first clip member at the midpoint of said second clip member, and having a notch at a center of said second clip member and wherein a plane of said first clip member is parallel to a plane of said second clip member; and a gripper insert attached to said first clip member along an inwardly disposed surface of said first clip member adjacent said pair of ends.

2. The support as recited in claim 1 wherein said first clip member has a rectangular cross sectional shape.

3. A support comprising:

a first clip member having a symmetrical curving pair of clip arms and having a pair of ends and a middle portion having a shallow notch;

a second clip member, attached to and smaller than said first clip member, and having a rounded shape including a main circular length having a pair of ends connected to a pair of symmetrical end portions which extend away from each other, said main circular length attached to the mid point of said first clip member at the midpoint of said second clip member, and having a narrow notch at a center of said second clip member; and a gripper insert attached to said first clip member along an inwardly disposed surface of each of said clip arms of said first clip member adjacent said pair of ends of said first clip member.

4. The support of claim 3 and wherein said gripper portion extends from said inwardly disposed surface of each of said arms of said first clip member around each of said ends of said first clip member and onto an outwardly disposed surface of each of said ends of said first clip member.

5. The support of claim 4 and wherein said gripper portion which extends from said inwardly disposed surface of each of said clip arms of said first clip member around each of said ends of each of said clip arms and onto an outwardly disposed surface of each of said clip arms of said first clip member, also extends through its associated clip arm.

* * * * *